US005160071A

United States Patent [19]

Wright

[11] Patent Number: 5,160,071

[45] Date of Patent: Nov. 3, 1992

[54] VERTICAL SPRAY BOTTLE NOZZLE

[76] Inventor: Keith D. Wright, 24071 Pinehurst, Laguna Niguel, Calif. 92677

[21] Appl. No.: 778,387

[22] Filed: Oct. 15, 1991

[51] Int. Cl.[5] ..... B67D 5/40

[52] U.S. Cl. ..... 222/383; 222/372; 222/473; 239/333; 239/375

[58] Field of Search ..... 222/174, 321, 372, 381–383, 222/385, 470–475; 239/333, 375

[56] References Cited

U.S. PATENT DOCUMENTS

| | | | |
|---|---|---|---|
| D. 294,989 | 3/1988 | Jinkins | D32/45 |
| 2,994,461 | 8/1961 | Michel | 222/153 |
| 3,035,737 | 5/1962 | Speas | 222/382 X |
| 3,337,096 | 8/1967 | Brown | 222/383 X |
| 3,377,004 | 4/1968 | Kjelson | 222/402.2 |
| 3,584,789 | 6/1971 | Traynor | 239/117 |
| 4,035,004 | 7/1977 | Hengesbach | 222/372 X |
| 4,470,526 | 9/1984 | Cha et al. | 222/383 X |
| 4,667,856 | 5/1987 | Nelson | 222/383 X |
| 4,739,904 | 4/1988 | Spencer et al. | 222/383 X |
| 4,865,230 | 9/1989 | Tugwood | 222/383 |
| 4,877,158 | 10/1989 | Kohler | 222/400.8 |

FOREIGN PATENT DOCUMENTS

| | | | |
|---|---|---|---|
| 967529 | 5/1975 | Canada | 222/382 |

*Primary Examiner*—Kevin P. Shaver
*Attorney, Agent, or Firm*—Stetina and Brunda

[57] ABSTRACT

The present invention relates to a liquid dispensing device for the downward application of a spray. The device generally comprises a liquid storage bottle defining a top surface and a plurality of side surfaces. Fluidly connected to the top surface of the storage bottle is a spray applicator defining a first portion threadably attached to and extending vertically upwardly from the top surface of the bottle and a second portion extending laterally from the first portion. The spray applicator further includes an outlet nozzle and trigger portion disposed on a distal end of the second portion in a manner wherein the outlet nozzle directs the spray in a downward direction upon actuation of the trigger.

12 Claims, 1 Drawing Sheet

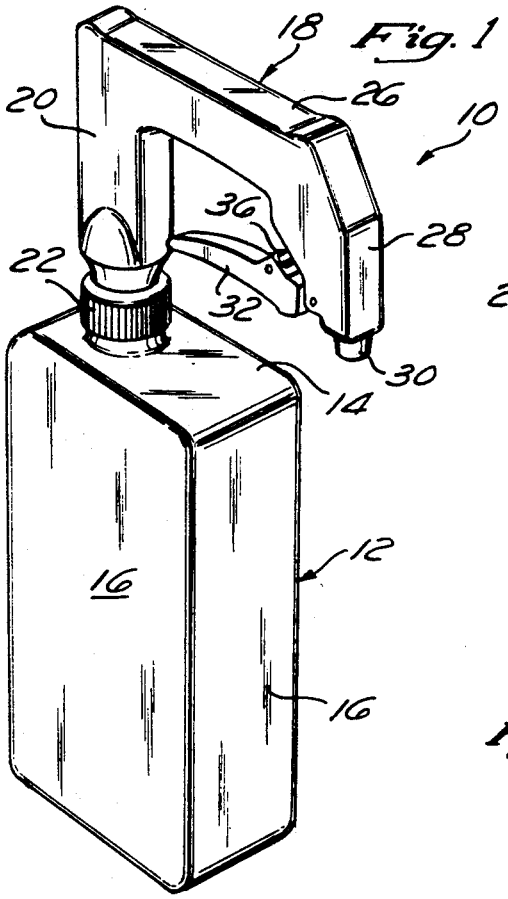
Fig. 1
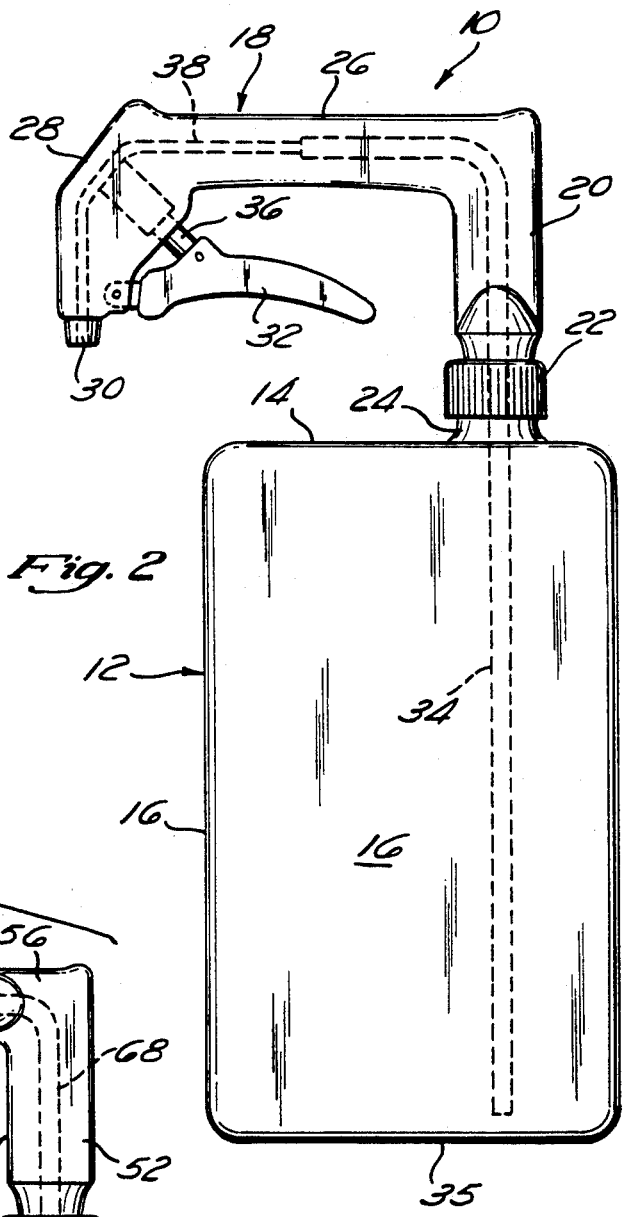
Fig. 2
Fig. 3
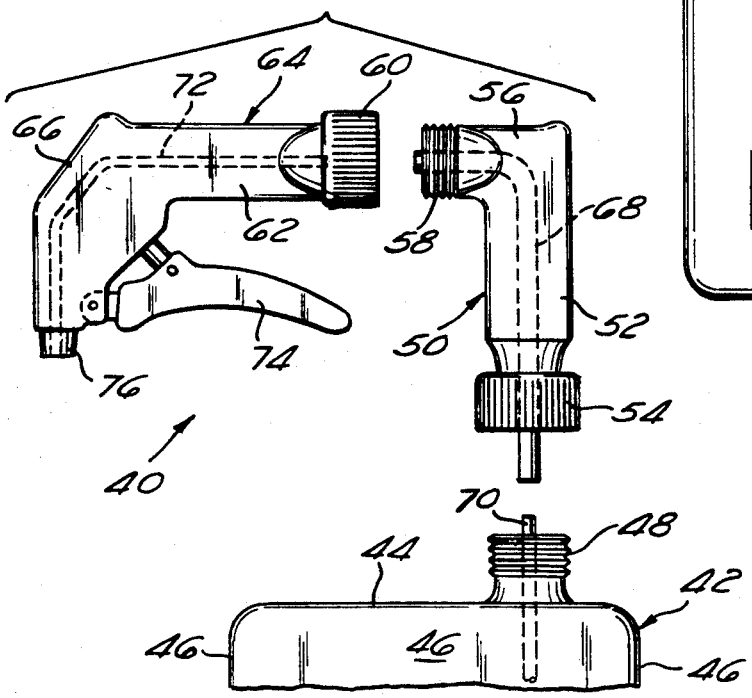

VERTICAL SPRAY BOTTLE NOZZLE

FIELD OF THE INVENTION

The present invention relates generally to liquid dispensing devices, and more particularly to a spray bottle which is adapted to spray liquids in a downward direction.

BACKGROUND OF THE INVENTION

Many items currently sold in drug stores, hardware stores and grocery stores are marketed in spray containers. Examples of such items include window cleaners, carpet cleaners/spot removers, cleaning products for bathrooms, countertops etc. and weed control products. Typically, such items comprise a bottle which includes a spray head attached thereto. The spray head includes a manual pump which is actuated by the hand of a user to disperse the particular liquid product in a spray or stream form to a desired surface. The fluid connection between the spray head and the bottle containing the liquid is usually facilitated by a feed tube which extends downwardly from the spray head and into the liquid. The feed tube is generally sized so as to extend to a location adjacent the bottom surface of the bottle so that the entire contents of the bottle may be dispersed via the spray head. In operation, the actuation of the manual pump by the user creates a suction in the feed tube thereby drawing liquid thereinto for subsequent dispersion via the spray head.

Though currently known spray containers are generally suitable for purposes of applying a particular liquid to a desired surface, such containers possess certain inherent deficiencies which detract from their overall utility. Foremost of these deficiencies is the requirement that such spray heads be horizontally oriented in order to properly function. In this respect, since the feed tube extends downwardly into the liquid within the bottle, tilting the bottle to its side to facilitate a downward spraying of the liquid from the spray head causes a loss of suction of the liquid into the feed tube thereby preventing the proper operation of the spray container. Thus, due to the construction of currently known spray containers, such containers are generally inoperable when used to apply a spray or stream of liquid in any direction other than a generally horizontal direction. This particular deficiency typically becomes more apparent as the liquid level in the bottle decreases. As will be recognized, the inability to apply a spray or stream in a downward direction creates significant difficulties when using such containers in specific spot applications such as weed removal and the cleaning of and removal of spots from carpets. The present invention alleviates these and other deficiencies associated with prior art spray containers.

SUMMARY OF THE INVENTION

In accordance with a preferred embodiment of the present invention, there is provided a liquid dispensing device for the downward application of a spray. The device comprises a liquid storage bottle having a top surface and a plurality of side surfaces. Fluidly connected to the bottle is a spray applicator which comprises a first portion attached to and extending vertically upwardly from the top surface of the bottle and a second portion extending laterally from the first portion. The spray applicator further comprises an outlet nozzle and trigger portion which is disposed on a distal end of the second portion in the manner wherein the outlet nozzle directs the spray in a downward direction upon actuation of the trigger. In the preferred embodiment, the spray applicator is threadably connected to the top surface of the storage bottle via the threadable connection of a female connector disposed on the first portion to a male connector formed on the top surface of the bottle. In the preferred embodiment, the second portion of the spray applicator extends horizontally at approximately a ninety-degree angle relative the first portion and the nozzle directs the spray downwardly at approximately a ninety-degree angle relative the second portion. Additionally, the second portion is sized to extend a horizontal distance sufficient to prevent the application of spray to any one of the side surfaces of the bottle during actuation of the trigger.

In accordance with a second embodiment of the present invention, there is provided a liquid dispensing device which also comprises a liquid storage bottle having a top surface and a plurality of side surfaces. Fluidly connected to the bottle is an elbow member comprising a first portion attached to and extending vertically upwardly from the top surface of the bottle and a second portion extending laterally from the first portion. A spray applicator having a base portion and a nozzle and trigger portion is fluidly connected to the elbow member in a manner wherein the nozzle directs the spray in a downward direction upon actuation of the trigger. In the second embodiment, the elbow member is threadably connected to the top surface of the storage bottle via the interface of a first female connector disposed on the first portion to a first male connector formed on the top surface of the bottle. Additionally, the elbow member is threadably connected to the spray applicator via the interface of a second female connector disposed on the base portion of the spray applicator to a second male connector formed on the distal end of the second portion of the elbow member.

In the second embodiment, the second portion of the elbow member extends horizontally at approximately a ninety-degree angle relative the first portion and the nozzle directs the spray downwardly at approximately a ninety-degree angle relative the second portion when the spray applicator is connected to the elbow member. Additionally, the second portion of the elbow member is preferably sized to extend a horizontal distance sufficient to prevent the application of spray to any one of the side surfaces of the bottle during actuation of the trigger.

BRIEF DESCRIPTION OF THE DRAWINGS

These as well as other features of the present invention will become more apparent upon reference to the drawings wherein:

FIG. 1 is a perspective view of a liquid dispensing device constructed in accordance with a preferred embodiment of the present invention;

FIG. 2 is a side elevational view of the dispensing device shown in FIG. 1; and

FIG. 3 is a side exploded view illustrating a liquid dispensing device constructed in accordance with a second embodiment of the present invention.

DETAILED DESCRIPTION OF THE PREFERRED EMBODIMENT

Referring now to the drawings wherein the showings are for purposes of illustrating preferred embodiments of the present invention only, and not for purposes of limiting the same, FIG. 1 perspectively illustrates a liquid dispensing device 10 constructed in accordance with the preferred embodiment of the present invention. Dispensing device 10 generally comprises a liquid storage bottle 12 having a top surface 14 and a plurality of side surfaces 16. Fluidly connected to the top surface 14 of bottle 12 is a spray applicator 18.

As best seen in FIG. 2, spray applicator 18 generally comprises a first portion 20 attached to and extending vertically upwardly from the top surface 14 of bottle 12. In the preferred embodiment, spray applicator 18 is threadably connected to bottle 12 via a female connector 22 disposed on the lower end of first portion 20. In this respect, female connector 22 is threadably received onto a male connector portion 24 formed on the top surface 14 of bottle 12. Though spray applicator 18 is preferably threadably connected to bottle 12, it will be recognized that other interconnection methods may be utilized as an alternative.

Extending laterally from the first portion 20 of spray applicator 18 is a second portion 26. An outlet nozzle and trigger portion 28 is disposed on the distal end of second portion 26 in a manner wherein an outlet nozzle 30 directs the spray in a downward direction upon actuation of a trigger 32 by the hand of a user. In the preferred embodiment, the second portion 26 extends horizontally at approximately a ninety-degree angle relative the first portion 20. Additionally, the outlet nozzle 30 is formed so as to direct the spray downwardly at approximately a ninety-degree angle relative the second portion 26. Further, the second portion 26 is preferably sized to extend a horizontal distance sufficient to prevent the application of spray to any one of the side surfaces 16 of the bottle 12 during actuation of the trigger 32.

As can be appreciated, spray applicator 18 is formed having conventional internal pumping structure (not shown) and functions in a manner substantially identical to currently known spray applicators manufactured by various sources. In this respect, the spray applicator 18 includes a feed tube 34 interfaced thereto which extends downwardly into the liquid contained within the storage bottle 12 when spray applicator 18 is connected thereto. As is typical in prior art spray applicators, feed tube 34 is sized so as to extend downwardly to a location substantially adjacent the lower surface 36 of the bottle 12. By having the feed tube 34 sized in this manner, the spray applicator 18 is able to draw substantially all of the liquid out of the bottle 12. Actuation of the trigger 32 causes a pump mechanism 36 to create a suction force in the feed tube 34 thereby drawing liquid thereinto. The liquid is channeled from the feed tube 34 through an outlet tube 38 for eventual dispersion via the outlet nozzle 30. Thus, the feed tube 34, outlet tube 38, pump mechanism 36, outlet nozzle 30 and trigger 32 collectively operate to draw liquid from within the bottle 12 and dispense such liquid through the nozzle 30 during actuation of the trigger 32. It will be recognized that outlet nozzle 30 may be selectively adjustable so as to apply the liquid in either a stream form or a more concentrated spray as conventional in the art.

Referring now to FIG. 3, illustrated is a dispensing device 40 constructed in accordance with a second embodiment of the present invention. Dispensing device 40 generally comprises a storage bottle 42 which defines a top surface 44 and a plurality of side surfaces 46. Formed on the top surface 44 is a first male connector 48.

Fluidly connected to the top surface 44 of bottle 42 is an elbow member 50. In the second embodiment, elbow member 50 generally comprises a first portion 52 which is attached to and extends vertically upwardly from the top surface 44 of bottle 12. Elbow member 50 is preferably threadably connected to bottle 42 via the threaded engagement of a first female connector 54 disposed on the lower end of first portion 52 to the first male connector 48. However, it will be appreciated that other interconnection methods may be utilized as an alternative.

Extending laterally from first portion 52 is a second portion 56. Formed on the distal end of second portion 56 is a second male connector 58. Importantly, second male connector 58 is sized so as to be threadably engageable to a second female connector 60 disposed on the distal end of a base portion 62 of a spray head 64. Spray head 64, which also includes a nozzle and trigger portion 66, is of conventional design and of the variety as currently utilized in conjunction with spray containers sold in the market place. As such, the utilization of the elbow member 50 allows the conventional spray head 64 to be interfaced to the bottle 42 in a manner permitting the downward application of a spray or stream.

To facilitate the transfer of liquid from within the bottle 42 into the spray head 64, disposed within the elbow member 50 is a transfer tube 68. Transfer tube 68 is sized and configured to be engageable to and seal against a feed tube 70 disposed within the bottle 42 when first female connector 54 is engaged to first male connector 48 and to an outlet tube 72 disposed within the spray head 64 when second female connector 60 is engaged to second male connector 58. As will be recognized, when transfer tube 68 is interfaced to feed tube 70 and outlet tube 72, the actuation of the trigger 74 of the spray head 64 causes liquid to be drawn from within bottle 42 and subsequently dispersed through nozzle 76. It will further be recognized that alternative methods may be utilized to interface the spray head 64 to the elbow member 50 other than through the utilization of the threaded interconnection. In this respect, all that is necessary is that the spray head 64 be interfaced to the elbow member 50 in a manner wherein the nozzle 76 directs a spray or stream in a downward direction upon actuation of the trigger 74.

In the second embodiment, the second portion 56 of elbow member 50 extends horizontally at approximately a ninety-degree angle relative the first portion 52. The spray head 64 is preferably interfaced to the second portion 56 in a manner so as to direct the spray downwardly at approximately a ninety-degree angle relative the second portion 56. Additionally, the second portion is preferably sized to extend a horizontal distance sufficient to prevent the application of spray to any one of the side surfaces 46 of the bottle 42 during actuation of the trigger 74.

Additional modifications and improvements of the present invention may also be apparent to those skilled in the art. Thus, the particular combination of parts as described and illustrated herein is intended to represent only one embodiment of the invention, and is not intended to serve as limitations of alternative devices within the spirit and scope of the invention.

What is claimed is:

1. A liquid dispensing device for the downward application of a spray, comprising:

a liquid storage bottle defining a top surface and at least one side surface; and a spray applicator fluidly connected to said bottle, said spray applicator comprising a generally L-shaped housing defining:

a first portion having a bottom end attached to said top surface of said bottle, said first portion extending vertically upward from said top surface of said bottle when attached thereto; and an elongate second portion extending laterally from said first portion and terminating at a head portion having an outlet nozzle and trigger attached thereto, said outlet nozzle being oriented so as to direct the spray in a downward direction upon actuation of said trigger.

2. The device of claim 1 wherein said spray applicator is threadably connected to said top surface of said storage bottle.

3. The device of claim 2 wherein said bottle includes a male connector formed on the top surface thereof and said bottom end of said first portion includes a female connector rotatably engaged thereto which is sized and configured to threadably receive said male connector.

4. The device of claim 1 wherein said second portion extends horizontally at approximately a ninety-degree angle relative said first portion and said nozzle directs the spray downwardly at approximately a ninety-degree angle relative said second portion.

5. The device of claim 4 wherein said second portion is sized to extend a horizontal distance sufficient to prevent the application of spray to said at least one side surface of said bottle during actuation of said trigger.

6. A liquid dispensing device for the downward application of a spray, comprising:

a liquid storage bottle defining a top surface and at least one side surface;

an elbow member fluidly connected to said bottle, said elbow member having a generally L-shaped configuration defining a first portion having a bottom end attached to said top surface of said bottle, said first portion extending vertically upward from said top surface of said bottle when attached thereto, and a second portion extending laterally from said first portion; and a spray applicator having a base portion and a head portion including a nozzle and trigger attached thereto, said base portion being fluidly connected to said elbow member and said nozzle being oriented so as to direct the spray in a downward direction upon actuation of said trigger.

7. The device of claim 6 wherein said elbow member is threadably connected to said top surface of said storage bottle.

8. The device of claim 7 wherein said bottle includes a first male connector formed on the top surface thereof and said bottom end of said first portion includes a first female connector rotatably engaged thereto which is sized and configured to threadably receive said first male connector.

9. The device of claim 8 wherein said spray applicator is threadably connected to said second portion of said elbow member.

10. The device of claim 9 wherein said base portion of said spray applicator includes a second female connector rotatably engaged thereto and said second portion of said elbow member includes a second male connector formed thereon which is sized and configured to be threadably receivable into said second female connector.

11. The device of claim 6 wherein said second portion extends horizontally at approximately a ninety-degree angle relative said first portion and said nozzle directs the spray downwardly at approximately a ninety-degree angle relative said second portion when said spray applicator is connected to said elbow member.

12. The device of claim 11 wherein said second portion is sized to extend a horizontal distance sufficient to prevent the application of spray to said at least one side surface of said bottle during actuation of said trigger.

* * * * *